US009272309B2

(12) United States Patent
Gaffie et al.

(10) Patent No.: US 9,272,309 B2
(45) Date of Patent: Mar. 1, 2016

(54) METHOD FOR APPLYING A PATTERN, SUCH AS A LOGO, ONTO THE OUTER SKIN OF AN AIRCRAFT ELEMENT

(71) Applicant: AIRCELLE, Gonfreville l'Orcher (FR)

(72) Inventors: Patrick Gaffie, Montaigut sur Save (FR); Romain Artinian, Toulouse (FR)

(73) Assignee: AIRCELLE, Gonfreville l'Orcher (FR)

( * ) Notice: Subject to any disclaimer, the term of this patent is extended or adjusted under 35 U.S.C. 154(b) by 0 days.

(21) Appl. No.: 14/100,249

(22) Filed: Dec. 9, 2013

(65) Prior Publication Data

US 2014/0099481 A1 Apr. 10, 2014

Related U.S. Application Data

(63) Continuation of application No. PCT/FR2012/051071, filed on May 14, 2012.

(30) Foreign Application Priority Data

Jun. 8, 2011 (FR) ..... 11 54977

(51) Int. Cl.

| | |
|---|---|
| ***B05D 7/00*** | (2006.01) |
| ***B44C 3/02*** | (2006.01) |
| ***B05D 7/14*** | (2006.01) |
| ***B05D 7/16*** | (2006.01) |
| ***B05D 5/00*** | (2006.01) |
| *G09F 21/08* | (2006.01) |

(52) U.S. Cl.

CPC .. *B05D 7/57* (2013.01); *B05D 5/00* (2013.01); *B05D 7/00* (2013.01); *B05D 7/14* (2013.01); *B05D 7/16* (2013.01); *B05D 7/50* (2013.01); *B05D 7/56* (2013.01); *B44C 3/02* (2013.01); *B05D 2202/00* (2013.01); *B05D 2503/00* (2013.01); *G09F 21/08* (2013.01); *Y10T 428/24802* (2015.01)

(58) Field of Classification Search

None

See application file for complete search history.

(56) References Cited

U.S. PATENT DOCUMENTS

2007/0036929 A1* 2/2007 Baird ..... B44C 1/1733 428/40.1

OTHER PUBLICATIONS

FR 2 972 652 A, English-language machine translation of description retrieved from Espacenet on Apr. 6, 2015, 26 pages.*

* cited by examiner

*Primary Examiner* — William Phillip Fletcher, III

(74) *Attorney, Agent, or Firm* — Brinks Gilson & Lione

(57) ABSTRACT

A method for applying a pattern, such as a logo, onto the outer skin of an aircraft element includes the following steps: a) applying a coat of paint onto the aircraft element; b) applying a top coat (base coat) onto the coat of paint; c) applying a first coat of transparent varnish (clear coat) onto the base coat; d) applying the pattern onto the first coat of transparent varnish; and e) applying a second coat of transparent varnish (clear coat) onto the pattern.

8 Claims, 1 Drawing Sheet

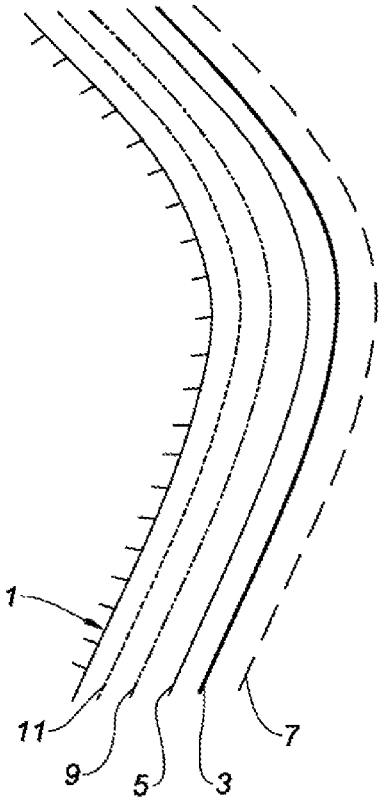
Fig. 1 Prior Art
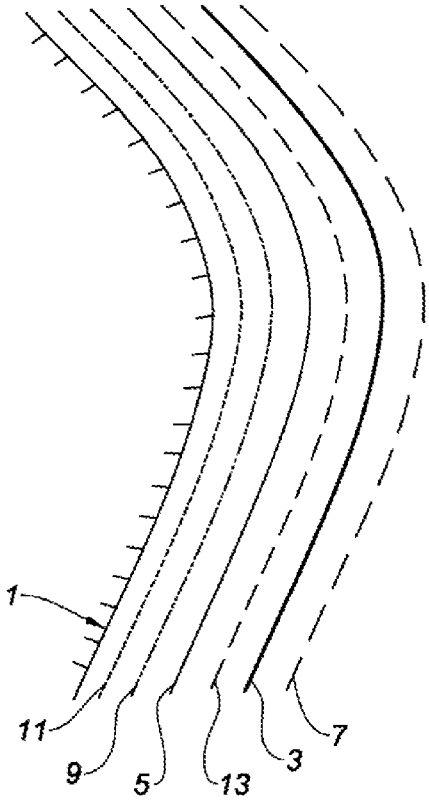
Fig. 2
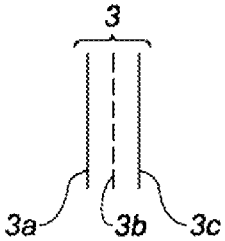
Fig. 3

METHOD FOR APPLYING A PATTERN, SUCH AS A LOGO, ONTO THE OUTER SKIN OF AN AIRCRAFT ELEMENT

CROSS-REFERENCE TO RELATED APPLICATIONS

This application is a continuation of International Application No. PCT/FR2012/051071, filed on May 14, 2012, which claims the benefit of FR 11/54977, filed on Jun. 8, 2011. The disclosures of the above applications are incorporated herein by reference.

FIELD

The present disclosure relates to a method for applying a pattern, such as a logo, onto the outer skin of an aircraft element.

BACKGROUND

The statements in this section merely provide background information related to the present disclosure and may not constitute prior art.

Traditionally, the outer elements of an aircraft are covered with a series of coats of specific paints and varnishes.

More specifically, these elements are successively covered with a coat of primer, an intermediate coat of paint, a base coat, and a coat of transparent varnish, also called "clear coat".

Typically, when one wishes to affix a pattern such as a logo on the concerned aircraft element (fuselage, nacelle, bypass, for example), it is placed on the base coat, and covered with the transparent clear coat.

One recurring problem that has been observed is a certain incompatibility between the logo and the base coat, leading to smudges on the periphery of the pattern to be affixed.

To clean these smudges, it is necessary to use degreasing products such as isopropyl alcohol, but then these products are chemically incompatible with the clear coat.

Efforts have been made to reduce the risk of the appearance of smudges by allowing the base coat to dry longer.

However, despite longer drying times (up to 72 hours), the aforementioned smudging problem has continued to appear.

SUMMARY

The present disclosure provides a method for applying a pattern, such as a logo, onto the outer skin of an aircraft element, which includes the following steps:

- applying at least one coat of paint onto said element;
- applying at least one top coat (base coat) on the coat of paint;
- applying at least one first coat of transparent varnish (clear coat) onto said base coat;
- applying said pattern onto said first coat of transparent varnish; and
- applying at least one second coat of transparent varnish (clear coat) onto said pattern.

Owing to these features, the first clear coat seals the base coat with respect to the glue of the pattern, thereby preventing it from being transferred to said base coat.

In this way, the smudges encountered in the prior art are avoided, without it being necessary to use degreasing products, or to observe lengthy drying times.

According to other optional features of the method according to the present disclosure:

- in step a), a coat of primer is applied on said element, then an intermediate coat on said primer coat;
- the substance forming said clear coats is chosen such that they withstand ultraviolet rays, and have a good brightness and a very smooth surface state;
- the substance forming said clear coats is chosen from the group comprising polyurethane coatings such as Desothane HS® BAC 900 by PRC/DeSoto or Eclipse® BAC 900 by Akzo-Nobel;
- for the pattern, a complex comprises an adhesive layer, a layer of ink and a carrier sheet;
- an acrylic glue is chosen for said adhesive;
- said ink is chosen from the group comprising acrylic inks, urethane inks, epoxy inks;
- said carrier sheet is chosen from the group comprising sheets made from acrylic, urethane, epoxy, vinyl, polyester.

The present disclosure also relates to a coating for an outer skin of an aircraft element, comprising:

- at least one coat of paint;
- at least one base coat applied on said coat of paint;
- at least one first clear coat applied on said base coat;
- at least one pattern applied on said clear coat; and
- at least one second clear coat applied on said pattern.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a cross-section of a coating for an outer aircraft element of the prior art;

FIG. 2 is a cross-section of a coating for an outer aircraft element according to the present disclosure; and FIG. 3 is a cross-section of one form of a complex able to form the pattern of the coating according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows an outer element 1 of an aircraft, which may for example be part of the fuselage, nacelle or bypass.

It is therefore desirable to affix a particular pattern 3 on that element, said pattern typically being able to be the figurative mark (logo) and/or verbal mark of the airline operating the aircraft.

Traditionally, this pattern is inserted between a base coat 5 and a clear coat 7, the latter typically being able to be obtained under the brands Desothane HS® BAC 900 by PRC/DeSoto or Eclipse® BAC 900 by Akzo-Nobel.

The base coat 5 is applied on an intermediate coat 9, which in turn is applied on a primer coat 11, which is applied on the element 1.

As an example, the base coat 5 may be the substance marketed under reference EP8 by the company Mankiewicz.

As indicated above, problems of chemical incompatibility exist between the base coat 5 and the ink of the pattern 3, causing smudges that are incompatible with the specifications required by clients, i.e., by the airlines.

To resolve this very unfavorable situation, and as shown in the appended FIG. 2, a clear coat 13, similar to that 7 which is applied on the pattern 3, is applied on the base coat 5.

This clear coat 13 forms a sealing barrier between the ink of the pattern 3 and the base coat 5, which it has been possible to see, after many tests, makes it possible to resolve the smudging problems of the prior art.

Since additionally, this clear coat 13 is transparent, it makes it possible to leave the color of the intermediate coat 9 and/or that of the primer coat 11 visible.

According to one possible form, shown in FIG. 3, for the pattern 3, a complex may comprise an adhesive layer 3*a*, a layer of ink 3*b* and a carrier sheet 3*c*.

For the adhesive, an acrylic glue 3*a* may be chosen.

The ink 3*b* may be an acrylic ink, a urethane ink, or any epoxy ink, for example.

The substrate sheet 3*c* may be made from acrylic, urethane, epoxy, vinyl, or polyester, for example.

Of course, the present disclosure is not limited to the forms described and illustrated, which have been provided solely as an example.

What is claimed is:

1. A method for applying a pattern onto the outer skin of an aircraft element, the method comprising steps:

a) applying at least one coat of paint onto said element;

b) applying at least one base coat on the coat of paint;

c) applying at least one first coat of transparent varnish onto said base coat;

d) applying said pattern onto said first coat of transparent varnish; and e) applying at least one second coat of transparent varnish onto said pattern.

2. The method according to claim 1, wherein in step a), a primer coat is applied on said element, then an intermediate coat on said primer coat.

3. The method according to claim 1, wherein a substance forming said first coat of transparent varnish and said second coat of transparent varnish is chosen such that they withstand ultraviolet rays.

4. The method according to claim 3, wherein the substance forming said first coat of transparent varnish and said second coat of transparent varnish is a polyurethane coating.

5. The method according to claim 1, wherein for the pattern, a complex comprises an adhesive layer, a layer of ink and a carrier sheet.

6. The method according to claim 5, wherein an acrylic glue is chosen for said adhesive.

7. The method according to claim 5, wherein said ink is chosen from the group consisting of acrylic inks, urethane inks, and epoxy inks.

8. The method according to claim 5, wherein said carrier sheet is chosen from the group consisting of acrylic, urethane, epoxy, vinyl, or polyester.

* * * * *